US008226357B2

(12) United States Patent
Bouru et al.

(10) Patent No.: US 8,226,357 B2
(45) Date of Patent: Jul. 24, 2012

(54) PITCH CONTROL RING FOR STATOR VANES OF A TURBOMACHINE

(75) Inventors: Michel Andre Bouru, Montereau sur le Jard (FR); Jean-Christophe Leininger, Massy (FR)

(73) Assignee: SNECMA, Paris (FR)

( * ) Notice: Subject to any disclaimer, the term of this patent is extended or adjusted under 35 U.S.C. 154(b) by 684 days.

(21) Appl. No.: 12/249,345

(22) Filed: Oct. 10, 2008

(65) Prior Publication Data

US 2009/0116954 A1 May 7, 2009

(30) Foreign Application Priority Data

Oct. 12, 2007 (FR) ..... 07 58244

(51) Int. Cl.
*F01D 17/12* (2006.01)

(52) U.S. Cl. ..... 415/150; 415/160; 415/208.2

(58) Field of Classification Search ..... 415/147–150, 415/159–166, 146, 208.2
See application file for complete search history.

(56) References Cited

U.S. PATENT DOCUMENTS

| | | | | |
|---|---|---|---|---|
| 3,685,920 | A * | 8/1972 | Burge | 415/147 |
| 4,773,821 | A * | 9/1988 | Gonthier et al. | 415/150 |
| 7,073,336 | B2 * | 7/2006 | Lepretre et al. | 60/751 |
| 2006/0133925 | A1 * | 6/2006 | Bouru | 415/160 |
| 2008/0148737 | A1 * | 6/2008 | Ellis et al. | 60/796 |

FOREIGN PATENT DOCUMENTS

| | | | |
|---|---|---|---|
| EP | 0 274 931 | A2 | 7/1988 |
| EP | 1 059 422 | A1 | 12/2000 |
| EP | 1 496 208 | A1 | 1/2005 |
| FR | 2 599 785 | | 12/1987 |
| GB | 2 412 946 | A | 10/2005 |
| RU | 2117826 | * | 8/1998 |

* cited by examiner

*Primary Examiner* — Steven Loke
*Assistant Examiner* — Victoria Hall
(74) *Attorney, Agent, or Firm* — Oblon, Spivak, McClelland, Maier & Neustadt, L.L.P.

(57) ABSTRACT

A turbomachine including a variable-pitch stator vane stage is disclosed. A control ring that is coaxial around the casing includes two segments that are assembled together by side connection straps fastened on either side of the segments with mutual insetting and in the vicinity of the ends of the segments.

13 Claims, 2 Drawing Sheets

PITCH CONTROL RING FOR STATOR VANES OF A TURBOMACHINE

The invention relates to a turbomachine, such as for example a compressor, presenting at least one ring of variable-pitch stator vanes. The invention relates more particularly to an improvement to the ring for controlling the orientation of variable-pitch vanes. The improvement makes it possible both to improve the stiffness of such a vane pitch control ring, and the accuracy with which it can be operated.

BACKGROUND OF THE INVENTION

A turbomachine is known, e.g. a high pressure compressor of an airplane turbojet, that includes at least one variable-pitch stator vane stage that is arranged circumferentially within a casing. Conventionally, the compressor is constituted by a rotor having a plurality of rotary blade stages that are offset axially, with a plurality of variable-pitch stator vane stages being installed between them. Each stator vane stage is thus constituted by a plurality of vanes arranged radially and circumferentially inside the casing that forms a kind of ring, the vanes being stationary in position but variable in orientation. The orientation of all of the vanes must be identical for the entire ring of variable-pitch stator vanes; it is modified as a function of operating conditions.

For this purpose, each vane has a control pivot projecting radially outside said casing, and each pivot is connected by a lever to a common control ring disposed coaxially around said casing and mounted to turn thereon. Generally, the ring is mounted to slide on the outside surface of the casing and it is actuated to turn about its own axis, which coincides with the axis of the turbomachine. Depending on the position of slider pads between the ring and the casing, and depending on the locations of anchor points for the control means, friction can represent up to 30% of the drive force required to move the set of vanes. The behavior of the ring itself during such movements can rise to problems. The ring is sometimes observed to ovalize, and that is harmful to operation thereof.

Generally, the ring is made up of a plurality of segments, e.g. two half-rings, that are assembled together around the casing. Thus, FR-2 125 012 describes a control ring made up of a plurality of segments assembled together by bridge-forming elements so as to form a complete ring. The bridge-forming elements are bolted between spaced-apart ends of the ring segments. Two ring segments and a bridge-forming element are assembled together by radial bolting. The bridge-forming elements are relatively flexible and act somewhat like flexible hinges that accentuate deformation of the ring. This can lead to dispersion amongst the angles of attack of the vanes that may be as great as two degrees of more. When the compressor forms part of a turboprop, this lack of accuracy increases the risk of the engine pumping.

OBJECT AND SUMMARY OF THE INVENTION

The invention serves simultaneously to simplify and stiffen the assembly of segments making up the control ring.

More particularly, the invention provides a turbomachine including a variable-pitch stator vane stage, arranged circumferentially in a casing, each vane having a control pivot that projects radially outside said casing and each pivot being connected by an arm to a common control ring that is disposed coaxially around said casing and that is mounted to turn on the outside thereof, wherein said ring comprises two segments that are assembled together by side connection straps fastened on either side of said segments with mutual insetting, at least in the vicinity of the ends of the segments.

Thus, radial bolting between the end portions of the ring segments using a bridge-forming element is replaced by bolting parallel to the axis, making use of two connection straps extending on either side of the ring segments. This provides an assembly of very great stiffness and accuracy, and that is more compact.

In one possible embodiment, said ring segments include side recesses into which said connection straps are set.

Advantageously, such a connection strap is an annular segment that is chamfered to define frustoconical surfaces, and said side recesses present a corresponding recessed profile, i.e. also presenting opposite flanks that are frustoconical.

In an inverse embodiment, such a connection strap is an annular segment including a recess into which end portions of said ring segments are set.

Under such circumstances, said ring segments may advantageously be chamfered to define four frustoconical surfaces that are superposed coaxially in pairs, and the above-mentioned recess in each side strap has two corresponding frustoconical facets co-operating respectively with such frustoconical surfaces that are coaxially superposed in pairs.

The frustoconical surfaces that contribute to assembly while the bolts are being tightened, facilitate positioning the parts relative to one another.

Said connection straps are bolted on either side of adjacent end portions of said ring segments, with at least one bolt for each end portion. Generally, two bolts are provided for each end portion.

It should be observed that in order to improve the accuracy of the assembly, a bolt shank fits the hole in which it is engaged in a ring segment end portion. If the assembly has more than one bolt per ring segment end portion, then it generally suffices, in order to obtain the desired accuracy, for only one bolt shank to fit per ring segment.

Furthermore, the ring includes at least one drive fork or the like whereby the drive force causing it to turn is transmitted thereto.

According to an advantageous characteristic, the fork presents a base that is fastened to one side of the ring with mutual insetting, in a manner analogous to an above-mentioned side strap. For example, the base itself forms one of said side straps.

When lateral recesses are defined on either side of the ring, the term "sides" being taken relative to its axial length direction, it is possible to form two grooves with frustoconical flanks on either side of a complete ring of rectangular or square radial section, and then to cut up the ring into a plurality of segments, e.g. and preferably, into two half-rings, after which the ring can be reconstituted around the casing by assembling together the segments by means of facing side connection straps bolted to the ends of the segments. Under such circumstances, the above-mentioned side recesses extend around the entire circumference of the ring as reconstituted in this way.

BRIEF DESCRIPTION OF THE DRAWINGS

The invention can be better understood and other advantages thereof appear better in the light of the following description given purely by way of example and made with reference to the accompanying drawings, in which.

MORE DETAILED DESCRIPTION

Figure 1:
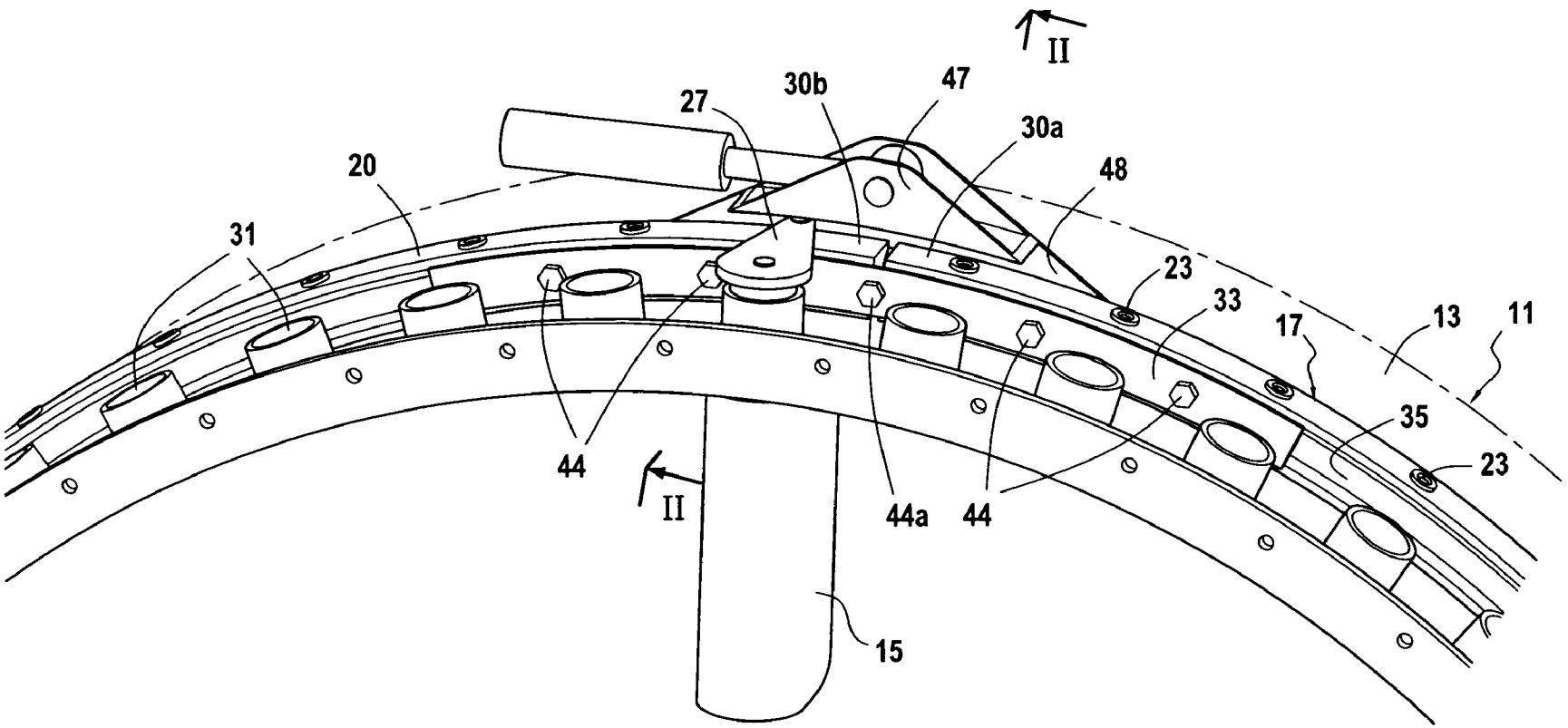
FIG. 1 is a fragmentary perspective view of a portion of a compressor of the type having a ring of adjustable-pitch stator vanes, with only one vane and its arm being shown in the drawing, for greater clarity.
Figure 2:
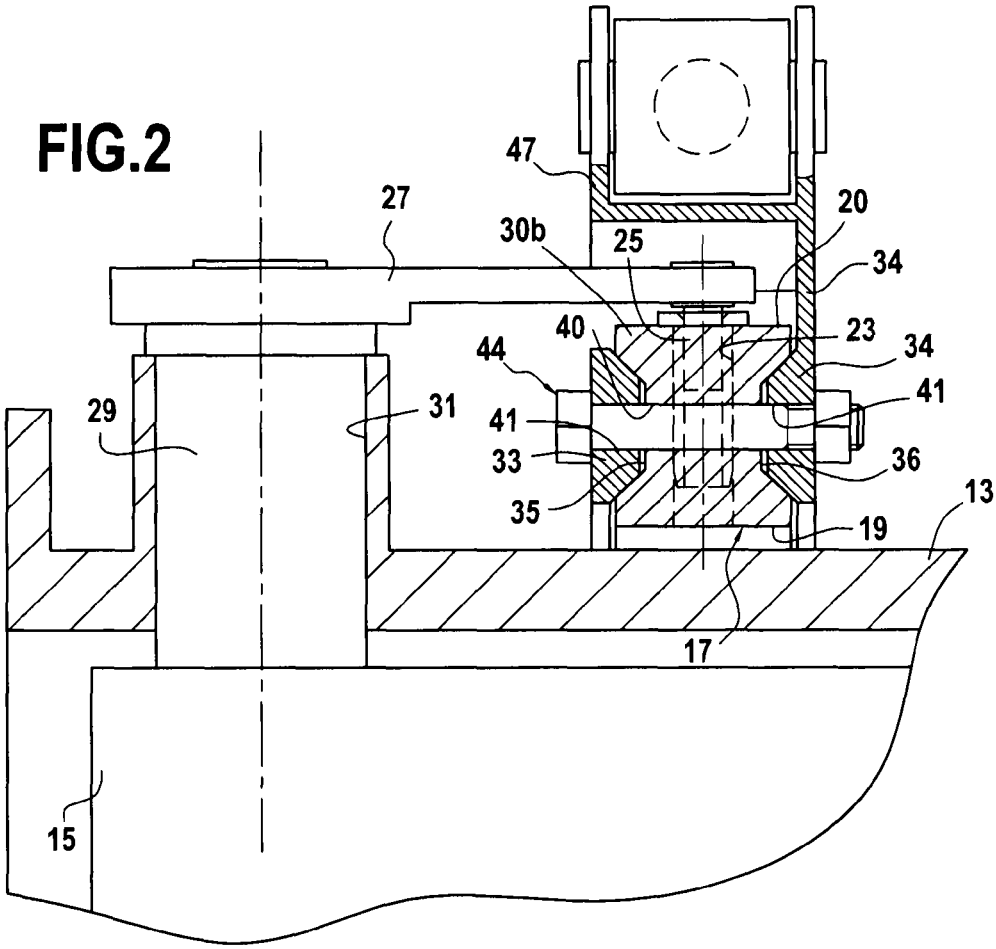
FIG. 2 is a section on II-II of FIG. 1.

FIGS. 1 and 2 show a portion of a turbomachine, specifically a compressor 11 comprising, in a casing 13, a ring of variable-pitch stator vanes 15, where the pitch can be adjusted by turning a control ring 17 mounted to turn on the outside of the casing. The control ring has two coaxial cylindrical faces 19 and 20. The inner face 19 rests on the outer surface of the casing via slider pads (not shown in the drawings). The center of the ring is situated on the axis of rotation of the turbomachine. Only one vane 15 can be seen in FIG. 1.

Radially extending holes 23 are formed at regular intervals through the control ring so as to open out into its outer face 20 in order to receive pins 25 of arms 27 for controlling the orientation of the vanes 15. The vanes are arranged circumferentially and radially within the casing 13. Each vane has a control pivot 29 projecting radially outwards from the casing, passing through a bore 31 therein. Each pivot is connected to the control ring by a specific arm 27. All of the above arrangement is conventional.

In order to enable it to be mounted on the outside of the casing, which includes projecting flanges, the ring is made as a plurality of segments 30*a*, 30*b* (at least two half-rings, for example) that are connected together end to end.

According to an important characteristic, the segments 30*a*, 30*b* of the ring are assembled together via lateral connection straps 33, 34 that are set into either side of said segment, at least in the vicinity of the ends thereof. In the example specifically described, said segments 30*a*, 30*b* have side recesses 35, 36 into which said connection straps 33, 34 are set. Such a connection strap is constituted in this example by an annular segment of trapezoidal section, i.e. it has two frustoconical surfaces. Under such circumstances, the side recesses 35, 36 have a corresponding recessed profile, i.e. they have two flanks with frustoconical surfaces that are complementary to the surfaces of the connection straps.

Side recesses 35, 36 could be formed solely near the ends of the segments 30*a*, 30*b* (half-rings) in order to enable them to be assembled together by the above-described connection straps. These recesses should be of a length that is sufficient to receive the connection straps. Nevertheless, in the embodiment shown, the side recesses 35, 36 extend around the entire circumference of the control ring. This results in a method of machining the ring that is advantageous. In this method, a complete ring of rectangular section is available and two grooves with frustoconical flanks are formed by machining the flat annular surfaces (perpendicular to the axis of rotation) of said ring. Thereafter, the ring is cut, e.g. into two equal portions, and holes 40 are made in the end portions of the segments made in this way. Corresponding holes 41 are made in the straps 33, 34. The segments are reassembled around the casing by means of bolts 44, involving at least one bolt 44 per segment, and here two bolts 44 that are disposed side by side in each segment 30*a* or 30*b*.

In addition, an additional bolt 44*a* may be provided in the middles of the two straps 33, 34 in register with the junction between the segments 30*a*, 30*b*.

When assembled in this way, the connection is particularly rigid and the geometrical and dimensional characteristics of the ring are particularly well controlled and stable over time.

Furthermore, the continuous side recesses 35 enable other elements to be connected to the control ring using the same type of inset assembly, e.g. for the purpose of mounting at least one fork 47 for connection to an actuator for driving the ring.

Under such circumstances, the fork presents a base that is fastened on one side of the ring, being inset therein, in a manner analogous to that shown for fastening the side straps. Advantageously, the base 48 is made integrally with one of the side straps (the strap 34), as shown.

Figure 3:
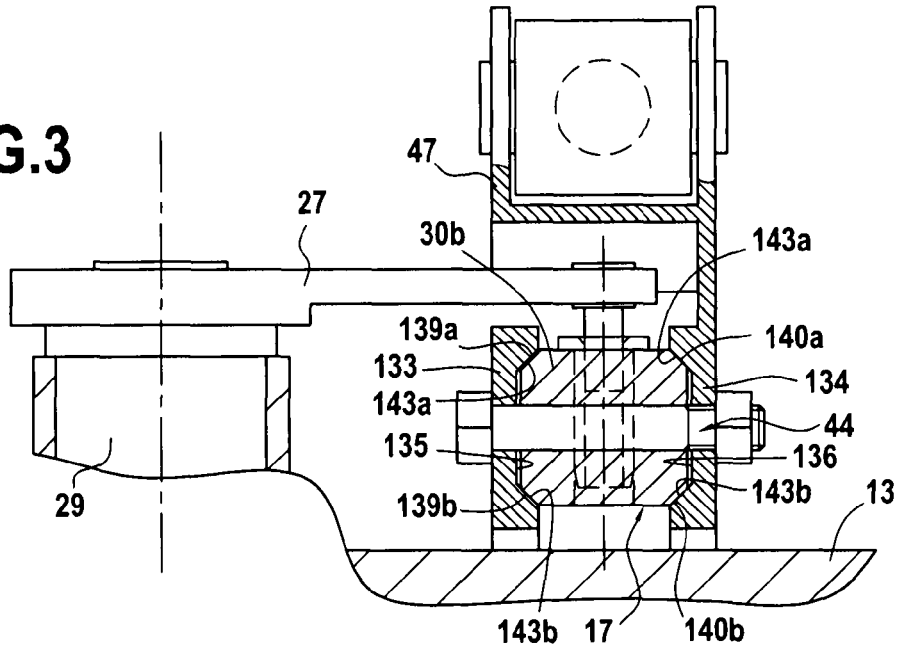
FIG. 3 is a view analogous to FIG. 2, showing a variant.

In the variant of FIG. 3, each connection strap 133, 134 is an annular segment including a recess 135, 136 having the end portions of segments of the ring 17 set into them.

Preferably, and as shown, the ring segments are chamfered so as to define four frustoconical surfaces 139*a* & 139*b* and 140*a* & 140*b* that are superposed in pairs coaxially, while the above-mentioned recesses 135 and 136 in each of the straps 133 and 134 have two corresponding frustoconical facets 143*a*, 143*b* that are co-operate respectively with such coaxially superposed pairs of frustoconical surfaces.

What is claimed is:

1. A turbomachine comprising:

a variable-pitch stator vane stage, arranged circumferentially in a casing, each vane having a control pivot that projects radially outside said casing and each pivot being connected by an arm to a common control ring that is disposed coaxially around said casing and that is mounted to turn on the outside thereof, wherein said control ring comprises two ring segments that are assembled together by side connection straps fastened on an upstream side and a downstream side of said ring segments with mutual insetting, at least in the vicinity of circumferential end portions of the ring segments, the side connection straps being separable from said ring segments, wherein two connection straps are fastened to the upstream side of each ring segment and two connection straps are fastened to the downstream side of each ring segment, and wherein said side connection straps are bolted on upstream and downstream sides of adjacent circumferential end portions of said ring segments with at least one bolt arranged parallel to an axis of the turbomachine for each circumferential end portion.

2. A turbomachine according to claim 1, wherein said ring segments include side recesses into which said side connection straps are set.

3. A turbomachine according to claim 2, wherein each of said side connection straps is an annular segment that is chamfered to define frustoconical surfaces, and wherein said side recesses present a corresponding recessed profile.

4. A turbomachine according to claim 1, wherein each of said side connection straps is an annular segment including a recess into which end portions of said ring segments are set.

5. A turbomachine according to claim 4, wherein said ring segments are chamfered to define four frustoconical surfaces that are superposed coaxially in pairs, and wherein the recess in each side connection strap has two corresponding frustoconical facets co-operating respectively with such frustoconical surfaces that are coaxially superposed in pairs.

6. A turbomachine according to claim 1, wherein the side connection straps are bolted to each circumferential end portion by two bolts.

7. A turbomachine according to claim 1, wherein a bolt shank fits a hole in which the bolt shank is engaged in the ring segment circumferential end portion.

8. A turbomachine according to claim 1, wherein an additional bolt is provided in the middle of two side connection straps.

9. A turbomachine according to claim 1, wherein said ring includes at least one drive fork, said fork presenting a base fastened on one side of said ring with insetting.

10. A turbomachine according to claim 9, wherein said base is formed integrally with one of said side connection straps.

11. A turbomachine according to claim 2, wherein said side recesses extend over the entire circumference of said ring.

12. A turbomachine according to claim 1, wherein said side connection straps abut said ring segments.

13. A turbomachine according to claim 1, wherein a downstream face of a head of the bolt abuts an upstream face of the side connection strap fastened on the upstream side of the ring segments.

* * * * *